US005168997A

United States Patent [19]

Czopor, Jr.

[11] Patent Number: 5,168,997

[45] Date of Patent: Dec. 8, 1992

[54] CARPENTER SQUARE PACKAGE AND SLEEVE THEREFORE

[75] Inventor: Edmund J. Czopor, Jr., Burlington, Conn.

[73] Assignee: The Stanley Works, New Britain, Conn.

[21] Appl. No.: 843,607

[22] Filed: Feb. 28, 1992

[51] Int. Cl.[5] ..... B65D 5/50

[52] U.S. Cl. ..... 206/349; 206/45.14; 206/371; 229/87.01

[58] Field of Search ..... 206/349, 371, 491, 495, 206/45.14, 45.31, 806; 229/87.01

[56] References Cited

U.S. PATENT DOCUMENTS

| | | | |
|---|---|---|---|
| 292,369 | 1/1884 | Schluchtner . | |
| 561,894 | 6/1896 | Jordan | 229/87.01 |
| 1,493,314 | 5/1924 | Zdrodowski . | |
| 2,439,568 | 4/1948 | Hall | 150/161 |
| 2,684,758 | 7/1954 | Aquino . | |
| 2,708,029 | 5/1955 | Kahn . | |
| 3,067,866 | 12/1962 | Burton | 206/349 |
| 3,227,268 | 1/1966 | Gringer | 206/349 |
| 3,487,922 | 1/1970 | Peck . | |
| 4,014,434 | 3/1977 | Thyen | 229/87.01 X |
| 4,650,074 | 3/1987 | Vosbikian . | |
| 4,747,491 | 5/1988 | Ward | 229/87.01 |
| 4,863,022 | 9/1989 | Czopor, Jr. . | |

FOREIGN PATENT DOCUMENTS

| | | | |
|---|---|---|---|
| 225849 | 3/1969 | Sweden | 206/349 |

*Primary Examiner*—Bryon P. Gehman

[57] ABSTRACT

A carpenter square display package utilizes an integrally formed display sleeve which is secured about the square at the corner by the intersecting legs. The sleeve has a pair of fold lines providing three elongated panels with the center panel being disposed on one planar face of a leg of the square and the outer panels being disposed in overlying relationship on its other planar face. One of the panels has an elongate flap folded about both of the faces of the corner and its end is engaged with another of the panels. The overlying panels are secured in their overlying relationship.

17 Claims, 3 Drawing Sheets

CARPENTER SQUARE PACKAGE AND SLEEVE THEREFORE

BACKGROUND OF THE INVENTION

The present invention relates to carpenter square display packages.

As is well known, carpenter squares generally comprise large and relatively flat L-shaped metallic elements. These are difficult to package for display purposes because of their size and their weight, as well as their relatively planar configuration.

As is also well known, it is desirable that tools be presented in an attractive manner in point of purpose displays, and that there be included a carton or sleeve which can be used to catch the user's attention, and bear manufacturer's identification information. In packaging tools, it is also desirable to provide an instruction sheet or packaging component which carries instructions for use of the tool, and which may be kept with the tool for future use.

It is an object of the present invention to provide a carpenter square package using a novel sleeve which may be rapidly and securely fastened about the square.

It is also an object to provide such a carpenter square package in which the sleeve may be readily disassembled from the square and repeatedly reassembled thereon.

Another object is to provide such a carpenter square package in which the display sleeve will indicate if it has been previously disassembled form the square to evidence possible tampering.

Still another object is to provide a novel display sleeve which may be readily and economically fabricated from paperboard stock, and which may be readily assembled about a carpenter square.

SUMMARY OF THE INVENTION

It has now been found that the foregoing and related objects may be readily attained in a carpenter square display package comprising a carpenter square having a pair of legs intersecting at a right angle to provide a corner with the legs each having substantially planar faces. An integrally formed display sleeve is secured about the square at its corner, and the sleeve has a pair of fold lines providing three elongated panels with the center one of the panels being disposed on one of the planar faces of one of the legs of the square and the outer panels extending about the side edges of this leg and being disposed in overlying relationship on the other of its planar faces. One of the panels has an elongated flap extending from its end and folded about both faces of the corner, and the flap has its end engaged with another of the panels. The sleeve also includes means securing the overlying panels in their overlying relationship.

In the preferred embodiment, the securing means comprises adhesive interposed between the overlying panels, and this adhesive is disposed in small amounts in at least two spaced locations and exhibits relatively little shear strength to permit the panels to be separated by application of a shear force. The securing means also includes a slit in one of the overlying panels providing a tab under which the edge of the other of the panels may be engaged to releasably engage the panels in overlying relationship about the square.

Most desirably, the elongated flap extends from the center panel, and the end of the flap extends between the overlying panels. There may also be included adhesive means releasably engaging the flap to one of the overlying panels, and the adhesive is desirably visible to provide a tamper indicator.

DETAILED DESCRIPTION OF THE ILLUSTRATED EMBODIMENT

Figure 1:
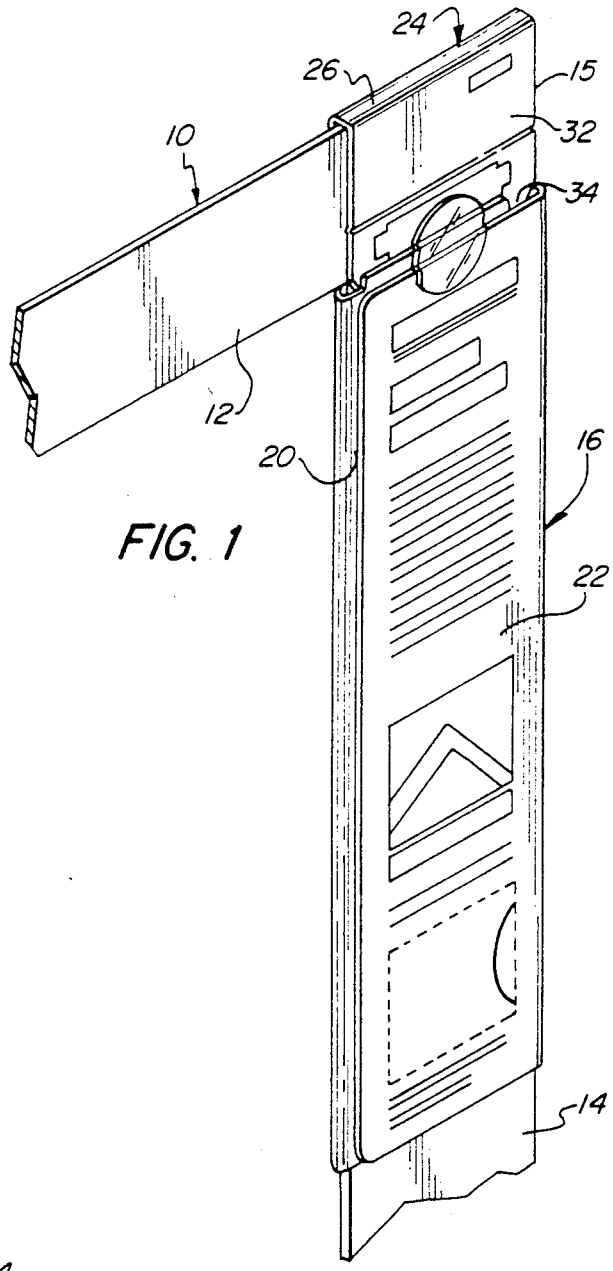
FIG. 1 is a fragmentary perspective view of a carpenter square package embodying the present invention with the sleeve in its packaged condition.

Turning now in detail to the attached drawings therein illustrated fragmentarily is a conventional carpenter's square generally designated by the number 10 and having a pair of right angularly disposed planar legs 12, 14 which intersect at the corner 15.

Encircling the one leg 14 adjacent the corner 15 is a sleeve embodying the present invention and generally designated by the numeral 16. The sleeve 16 has an elongated end flap generally designated by the numeral 24 extending about the corner 15 and having its end portion engaged under the body portion of the sleeve 16.

Figure 2:
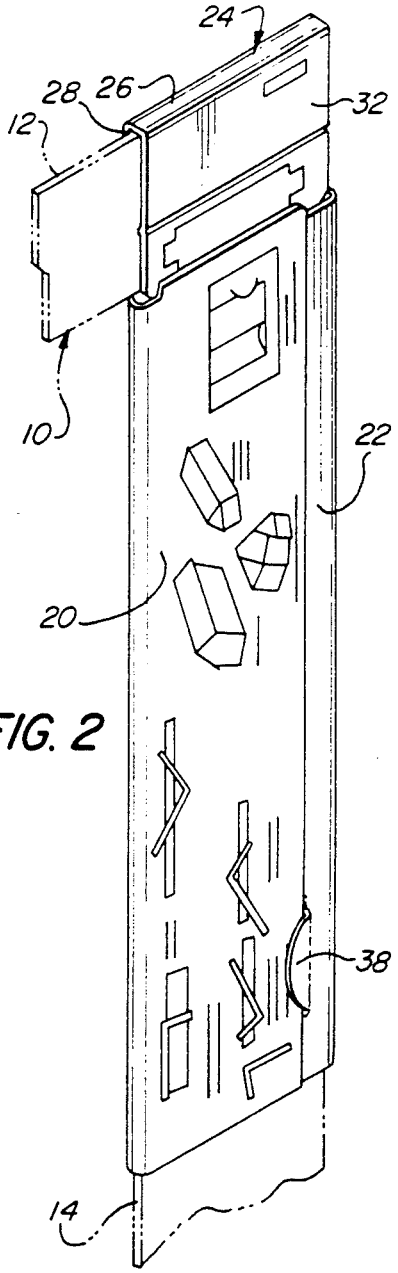
FIG. 2 is a perspective view of the sleeve after it has been initially disassembled and then remounted about a square which is shown fragmentarily in phantom line.
Figure 3:
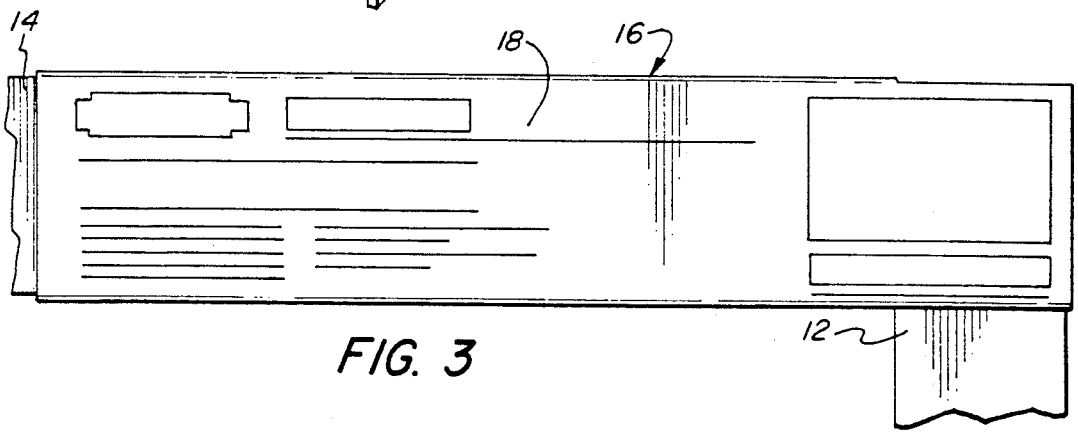
FIG. 3 is a fragmentary plan view of the package of FIG. 1 showing the opposite side of the sleeve from that seen in FIG. 1.
Figure 4:
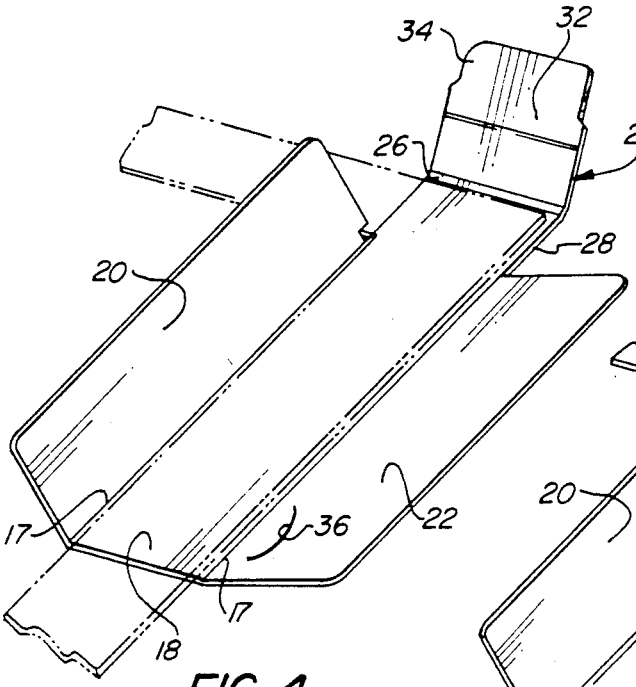
FIGS. 4–7 are fragmentary perspective views showing the several steps in the assembly of the sleeve about a square fragmentarily illustrated in phantom line.

As seen in FIG. 4, the sleeve 16 has a pair of parallel extending score or fold lines 17 extending longitudinally thereof and dividing it into a center panel 18 and outer panels 20, 22. The end flap 24 extends from the center panel 18, and it has a transversely extending fold line 26 dividing the end flap into a first panel 28 which lies int he plane of the center panel 18, and an end panel 32 with a tuck tab 34. As seen in FIGS. 1 and 2, the fold line 26 coincides with the outside edge of the leg 12 and enables the flap to fold back upon itself so that the tuck tab 34 will seat under the overlying outer panels 20, 22 when they are engaged, as shown both in FIG. 1 and in FIG. 2.

The panel 22 has an arcuate slit 36 therein adjacent the fold line 17 which provides a lock tab 38 under which the panel 20 may be engaged when the sleeve is reassembled about the square 10 with the panel 20 in the overlying position, as shown in FIG. 2.

Figure 5:
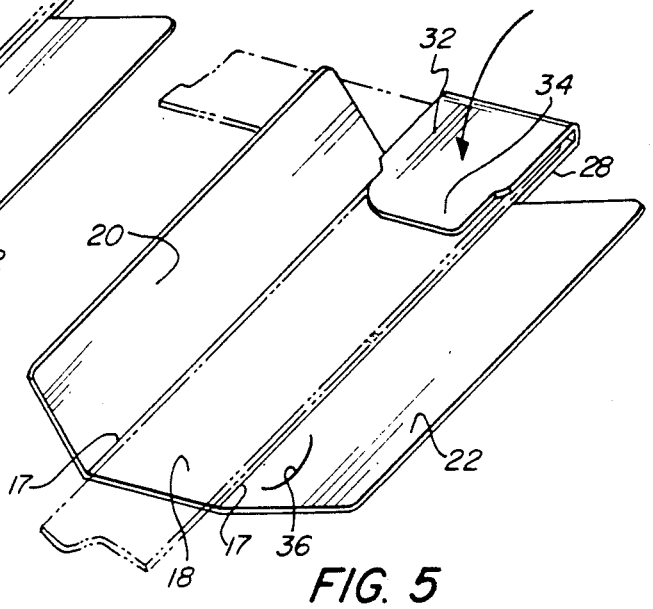
Figure 6:
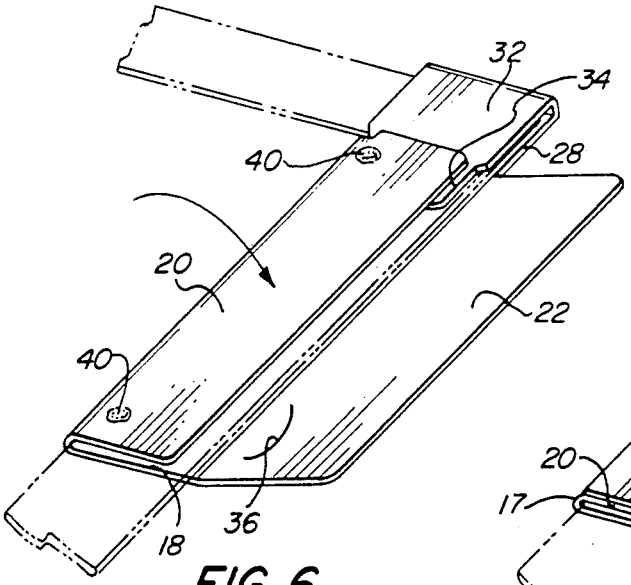
Figure 7:
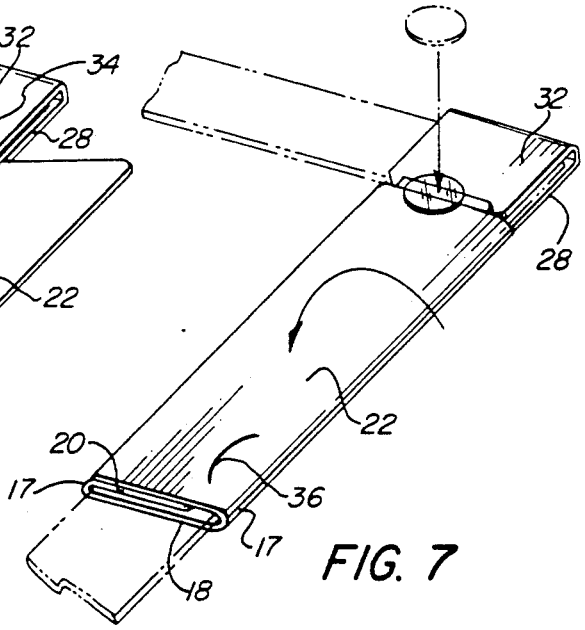

In the initial assembly of the sleeve about the square as shown in FIGS. 4–7, the square 10 is placed upon the sleeve 16 so that the leg 14 is disposed upon the center panel 18, and the end flap 24 is folded about the corner 15 as seen in FIG. 5 so that the end panel 32 and its tuck tab 34 lie on the other surface of the leg 14. The outer panel 20 is then folded over the tuck tab 34, and two spaced patches 40 of adhesive are applied to its upper surface adjacent the fold line 17 between it and the center panel 19. The other outer panel 22 is then folded over and engage with the adhesive patches 40. A label 42 with a pressure sensitive adhesive is placed over the juncture between the outer panel 22 and the ned flap 34 so as to provide a tamper seal therebetween.

When the purchaser desires to disassemble the square 10 from the sleeve 16, the adhesive label 42 may be readily broken permitting the tuck tab 34 to be slid outwardly from under the panel 20 at which point the sleeve 16 can be slid downwardly along the leg 14 to remove it from the square 10.

If the user wishes to review instructions and other printed material appearing upon the inside of the sleeve 16, the adhesive bond provided by the adhesive patches 40 may be sheared and the outer panels 20, 22 unfolded to permit reading of all printed matter on the interior of the sleeve 16. If the user then wishes to reassemble the sleeve 16 about the square 10, the square 10 may be placed upon the center panel 18, the end flap 24 folded as shown in FIG. 2, the panel 22 folded over the tuck tab 34, and the panel 20 folded over to engage under the lock tab 38 of the panel 20, as seen in FIG. 2.

Figure 8:
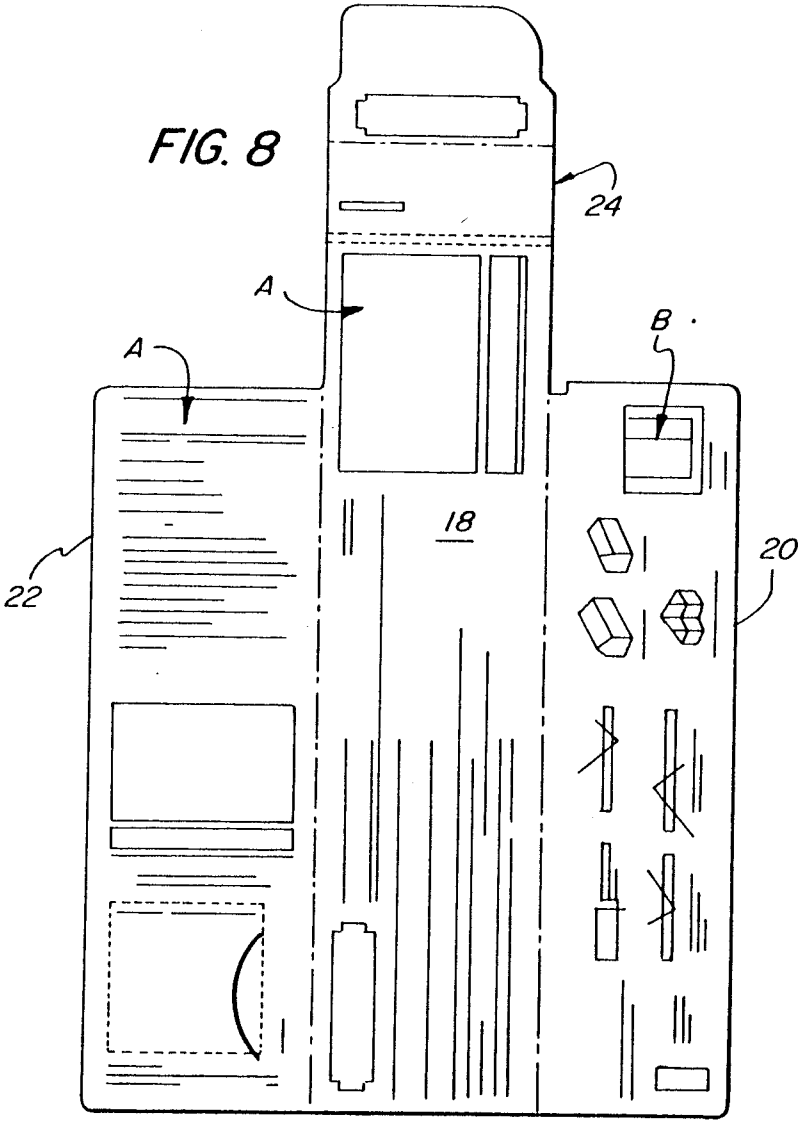
FIGS. 8 and 9 are plan views of the two sides of the sleeve in unfolded condition showing schematically variations in printed matter which may appear on the several surfaces of the panels.
Figure 9:
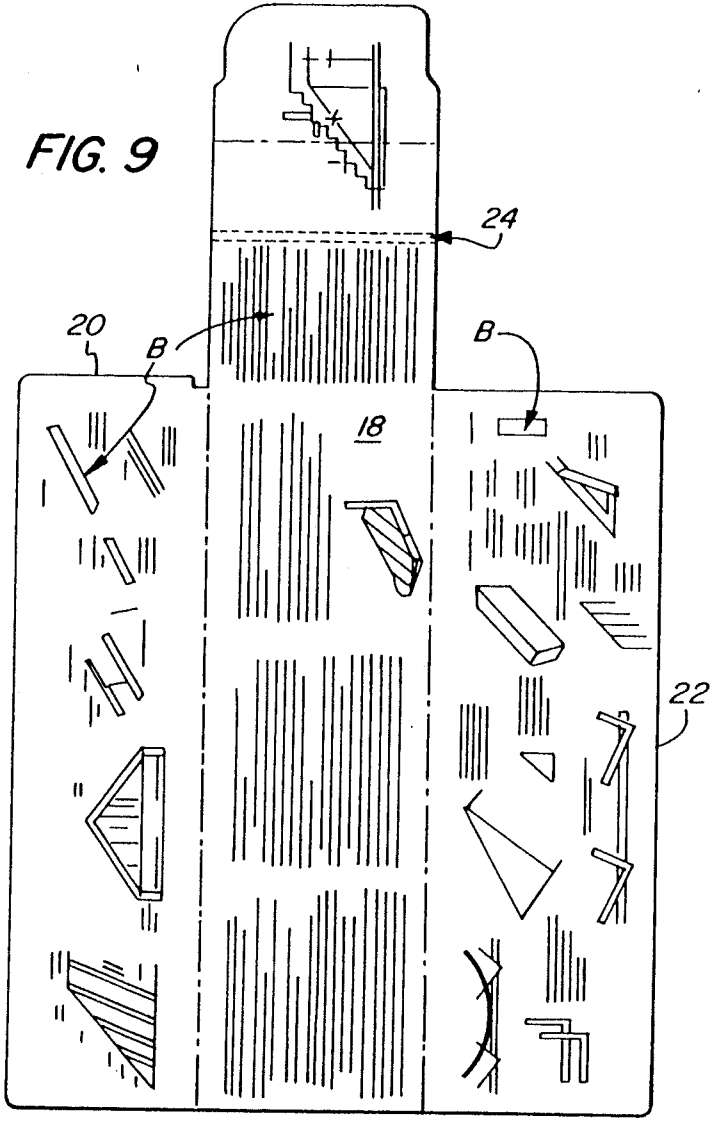

FIGS. 8 and 9 schematically illustrate the type of printed matter which may appear upon the sleeve 16. For purposes of the point of purchase display, the outer surface of the center panel 18 and the outer surface of the panel 22 on can be imprinted with manufacturer's identifications, promotional information, etc., as generally indicated by the letter A. The entire opposite surface of the sleeve 16, and the outer surface of the outer panel 20 may be imprinted with instructional information and diagrams as indicated by the letter B. Thus, four panel surfaces are available for instructional information and the two exposed panel surfaces in the initially assembled from are available to provide an attractive point of purchase display.

As can be seen in the attached drawings, the tuck tab at the end of the elongated flap is of lesser width than the principal portion of the end flap so as to facilitate its insertion and withdrawal from under the overlying elongated panels. As can also be seen, the upper end of the sleeve abuts against the inside edge of the other leg of the square so as to position the sleeve and facilitate the folding of the flap about the corner and its insertion under the overlying panels.

A single relatively wide score line or crease line will be sufficient to enable the folding of the sleeve about the relatively thin edges of the square. However, if so desired, two narrower and closely spaced fold lines may be substituted if a "square" appearance for the edges of the sleeve is desired rather than the arcuate surface which will generally be formed by a single fold line.

The adhesive employed to secure the overlying panels in assembly should be of sufficient strength to avoid premature and inadvertent disengagement of the overlying panels, but it should not be of such quantity of strength as to require the application of such force as might tear or otherwise injure the opposed faces of the sleeve if instructions and other information are to be imprinted thereon. Moreover, if so desired, an ever-tacky adhesive may be employed to enable some adhesive reengagement on the two overlying panels. Paper and foil decals are conveniently employed for the tamper seal application. However, an adhesive patch may be deposited so that it extends across the juncture of the overlying panels and end flap to provide both a bond and an indicator.

Thus, it can be seen from the foregoing detailed specification and attached drawings that the carpenter square package of the present invention is one which may be readily assembled upon the square of the factory, and thereafter readily disassembled and repeatedly reassembled thereon. The sleeve may be readily and economically fabricated from paperboard stock, and it may incorporate a tamper indicator. The result is a highly attractive and readily usable sleeve for point of purchase display packaging which may be retained and reassembled to associate instructions with the square for further use.

Having then described the invention, what is claimed is:

1. A carpenter square display package comprising:

(a) a carpenter square having a pair of legs intersecting at a right angle to provide a corner, said legs each having substantially planar faces and side edges;

(b) an integrally-formed display sleeve secured about said square at said corner, said sleeve having a pair of parallel fold lines providing three elongated panels comprising a pair of outer panels and a center panel, said center panel being disposed on one of said planar faces of one of said legs of said square and said outer panels extending about the side edges of said one of said legs and being disposed in overlying relationship on the other of said planar faces, one of said panels having an elongated flap folded about both faces of said corner and having its end engaged with another one of said panels; and (c) securing means securing said overlying panels in said overlying relationship.

2. The carpenter square display package in accordance with claim 1 wherein said securing means comprises adhesive interposed between said overlying panels.

3. The carpenter square display package in accordance with claim 2 wherein said adhesive is disposed in small amounts in at least two spaced locations and permits said panels to be separated by application of shear force.

4. The carpenter square display package in accordance with claim 1 wherein said securing means includes a slit in one of said overlying panels providing a tab under which the edge of the other of said panels may be engaged to releasably engage said panels in overlying relationship about said square.

5. The carpenter square display package in accordance with claim 1 wherein said elongated flap extends from said center panel.

6. The carpenter square display package in accordance with claim 5 wherein said end of the elongated flap end extends under said overlying panels.

7. The carpenter square display package in accordance with claim 6 wherein there is included adhesive means releasably engaging said elongated flap to one of said overlying panels.

8. The carpenter square display package in accordance with claim 7 wherein said adhesive means is a label element visible to provide a tamper indicator.

9. A carpenter square display package comprising:

(a) a carpenter square having a pair of legs intersecting at a right angle to provide a corner, said legs each having substantially planar faces and side edges;

(b) an integrally-formed display sleeve secured about said square at said corner, said sleeve having a pair of parallel fold lines providing three elongated panels comprising a pair of outer panels and a center panel, said center panel being disposed on one of said planar faces of one of said legs of said square and said outer panels extending about the side edges of said one of said legs and being disposed in overlying relationship on the other of said planar faces, one of said panels having an elongated flap folded about both faces of said corner and having its end engaged with another one of said panels; and (c) adhesive interposed between said securing said overlying panels in said overlying relationship, said adhesive being disposed in small amounts in at least two spaced locations and permitting said panels to be separated by application of shear force, said securing means also including a slit in one of said overlying panels providing a tab under which the edge of the other of said panels may be engaged to releasably engage said panels in overlying relationship about said square after the adhesive bond between the panels has been broken.

10. The carpenter square display package in accordance with claim 9 wherein said elongated flap extends from said center panel and its end extends under said overlying panels.

11. The carpenter square display package in accordance with claim 10 wherein there is included adhesive means releasably engaging said elongated flap to one of said overlying panels.

12. The carpenter square display package in accordance with claim 11 wherein said adhesive means is a label element visible to provide a tamper indicator.

13. An integrally-formed carpenter square display sleeve for use with a carpenter square having a pair of legs intersecting at a right angle to provide a corner, said sleeve being adapted to be secured about an associated carpenter square at its corner, said sleeve having a pair of parallel fold lines providing three elongated panels comprising a pair of outer panels and a center panel, said center panel being adapted to be disposed on one of the faces of one of the legs of the associated carpenter square, and said outer panels being disposed in overlying relationship and being adapted to be disposed against the other of the planar faces of the associated carpenter square, said center panel having an elongated flap extending from one end thereof and folded back upon itself, with its end engaged with another of said panels, said flap being adapted to extend about the corner of the associated carpenter square, and securing means securing said overlying panels in said overlying relationship.

14. The display sleeve in accordance with claim 13 wherein said securing means comprises adhesive interposed between said overlying panels, and wherein said adhesive is disposed in small amounts in at least two spaced locations and permits said panels to be separated by application of shear force.

15. The display sleeve in accordance with claim 13 wherein said securing means includes a slit in one of said overlying panels providing a tab under which the edge of the other of said panels may be engaged to releasably engage said panels in overlying relationship about the associated square.

16. The display sleeve in accordance with claim 13 wherein said end of said elongated flap extends under said overlying panels.

17. The display sleeve in accordance with claim 16 wherein there is included an adhesive means releasably engaging said flap to one of said overlying panels.

* * * * *